US010155387B2

(12) United States Patent
Ueki et al.

(10) Patent No.: US 10,155,387 B2
(45) Date of Patent: Dec. 18, 2018

(54) INKJET HEAD AND PRINTER

(71) Applicant: KYOCERA Corporation, Kyoto-shi, Kyoto (JP)

(72) Inventors: Chitoshi Ueki, Kyoto (JP); Takuji Hashiguchi, Kyoto (JP); Keiichi Kotani, Kyoto (JP); Akinori Hirashima, Kyoto (JP)

(73) Assignee: KYOCERA Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 15/520,517

(22) PCT Filed: Oct. 8, 2015

(86) PCT No.: PCT/JP2015/078616
§ 371 (c)(1),
(2) Date: Apr. 20, 2017

(87) PCT Pub. No.: WO2016/067880
PCT Pub. Date: May 6, 2016

(65) Prior Publication Data

US 2017/0313078 A1 Nov. 2, 2017

(30) Foreign Application Priority Data

Oct. 31, 2014 (JP) ..... 2014-222199

(51) Int. Cl.
*B41J 2/16* (2006.01)
*B41J 2/14* (2006.01)

(52) U.S. Cl.
CPC ..... *B41J 2/1623* (2013.01); *B41J 2/14056* (2013.01); *B41J 2/14233* (2013.01);
(Continued)

(58) Field of Classification Search
CPC ..... B41J 2/162; B41J 2/1623; B41J 2/1634; B41J 2/14056; B41J 2002/14217;
(Continued)

(56) References Cited

U.S. PATENT DOCUMENTS

2002/0036678 A1* 3/2002 Ito ..... B41J 2/14209 347/71
2002/0154198 A1* 10/2002 Sakamoto ..... B41J 2/14233 347/70
2005/0099468 A1 5/2005 Lu et al.

FOREIGN PATENT DOCUMENTS

JP 2006-264113 A 10/2006
JP 2009-061793 A 3/2009
(Continued)

OTHER PUBLICATIONS

International Search Report, PCT/JP2015/078616, dated Dec. 15, 2015, 2 pgs.

*Primary Examiner* — Huan Tran
*Assistant Examiner* — Alexander D Shenderov
(74) *Attorney, Agent, or Firm* — Volpe and Koenig, P.C.

(57) ABSTRACT

A head includes the passageway member which is configured by a plurality of plates stacked through the adhesive and in which the ink passageways are configured by communication of the through holes individually formed in the plurality of plates to each other. The plurality of plates includes the resin plate and a plurality of metal plates. The resin plate does not have a relief groove for the adhesive. The plurality of metal plates include the eighth metal plate and/or ninth metal plate which is adhered to the resin plate and includes the relief groove for the adhesive on the resin plate side.

12 Claims, 10 Drawing Sheets

(52) U.S. Cl.
CPC ..... *B41J 2/161* (2013.01); *B41J 2/162* (2013.01); *B41J 2/1629* (2013.01); *B41J 2/1631* (2013.01); *B41J 2/1632* (2013.01); *B41J 2/1634* (2013.01); *B41J 2002/14217* (2013.01); *B41J 2002/14362* (2013.01); *B41J 2002/14419* (2013.01); *B41J 2002/14459* (2013.01); *B41J 2002/14491* (2013.01); *B41J 2202/19* (2013.01); *B41J 2202/20* (2013.01)

(58) Field of Classification Search
CPC .... B41J 2002/14491; B41J 2002/14362; B41J 2202/19; B41J 2202/20
USPC ..... 347/47
See application file for complete search history.

(56) References Cited

FOREIGN PATENT DOCUMENTS

| | | | |
|---|---|---|---|
| JP | 2009-126012 | A | 6/2009 |
| JP | 2009-178844 | A | 8/2009 |
| JP | 2009-202338 | A | 9/2009 |
| JP | 2009-202454 | A | 9/2009 |

* cited by examiner

INKJET HEAD AND PRINTER

TECHNICAL FIELD

The present invention relates to an inkjet head and a printer including the inkjet head.

BACKGROUND ART

An inkjet head has a passageway member having ink passageways formed therein. As this passageway member, there is known a member configured by stacking a plurality of plates (for example Patent Literatures 1 to 3). In each plate, through holes are formed. The passageways of ink are configured by communication of these through holes with each other. The plurality of plates are generally configured by metal plates and are fixed to each other via an adhesive between the plates.

Patent Literature 1 discloses to reduce excess adhesive flowing into the passageways of ink by the technique of forming relief grooves (concave portions) for the adhesive in the surfaces of the plates. Patent Literatures 2 and 3 disclose a technique of using resin plates for predetermined plates while basically using metal plates.

CITATION LIST

Patent Literatures

Patent Literature 1: Japanese Patent Publication No. 2006-264113A

Patent Literature 2: Japanese Patent Publication No. 2009-178844A

Patent Literature 3: Japanese Patent Publication No. 2009-202454A

SUMMARY OF INVENTION

Technical Problem

In order to improve image quality, preferably the passageway member is formed with a high precision. On the other hand, if forming the passageway member with a high precision, the cost increases. Patent Literatures 1 to 3 do not allude to the effects of the combination of relief grooves and the material of the plates (metal or resin) exerted upon the precision and cost of the passageway member.

Accordingly, an inkjet head and printer capable of forming relief grooves for an adhesive cheaply and highly precisely are desirably provided.

Solution to Problem

An inkjet head according to one aspect of the present invention is an inkjet head including a passageway member which is configured by a plurality of plates stacked via an adhesive, in which a passageway of ink is configured by communication of through holes or grooves that are individually provided in the plurality of plates. The plurality of plates include a resin plate and a plurality of metal plates. The resin plate does not include a relief groove for the adhesive. The plurality of metal plates include a metal plate which is adhered to the resin plate and includes a relief groove for the adhesive on the resin plate side.

Preferably, the plurality of metal plates include a metal plate which is adhered to one surface of the resin plate and includes a relief groove for the adhesive on the resin plate side, and a metal plate which is adhered to the other surface of the resin plate and includes a relief groove for the adhesive on the resin plate side.

Preferably, the plurality of metal plates include one or more metal plates which are stacked in order on one surface of the resin plate and individually include relief grooves for the adhesive on only the resin plate side, and one or more metal plates which are stacked in order on the other surface of the resin plate and individually include relief grooves for the adhesive on only the resin plate side.

Preferably, the plurality of plates include a nozzle plate including a nozzle. Between the nozzle plate and the resin plate, a first part comprised of the metal plate including the relief groove for the adhesive on both surfaces is stacked. Between the first part and the resin plate, a metal plate is not stacked or, if it is stacked, the metal plate stacked between the first part and the resin plate includes a relief groove for the adhesive only on the resin plate side. Between the first part and the nozzle plate, a metal plate is not stacked or, if it is stacked, the metal plate stacked between the first part and the nozzle plate includes a relief groove for the adhesive only on the nozzle plate side. The nozzle plate does not include a relief groove for the adhesive.

Preferably, in the metal plate of the first part, the relief groove on the resin plate side and the relief groove on the nozzle plate side are not superimposed over each other.

A printer according to another aspect of the present invention includes the above inkjet head and a conveyor carrying media with respect to the inkjet head.

Advantageous Effect of Invention

According to the above configuration, a relief groove for an adhesive can be formed cheaply and highly precisely.

DESCRIPTION OF EMBODIMENTS (Schematic Configuration of Printer)

Figure 1:
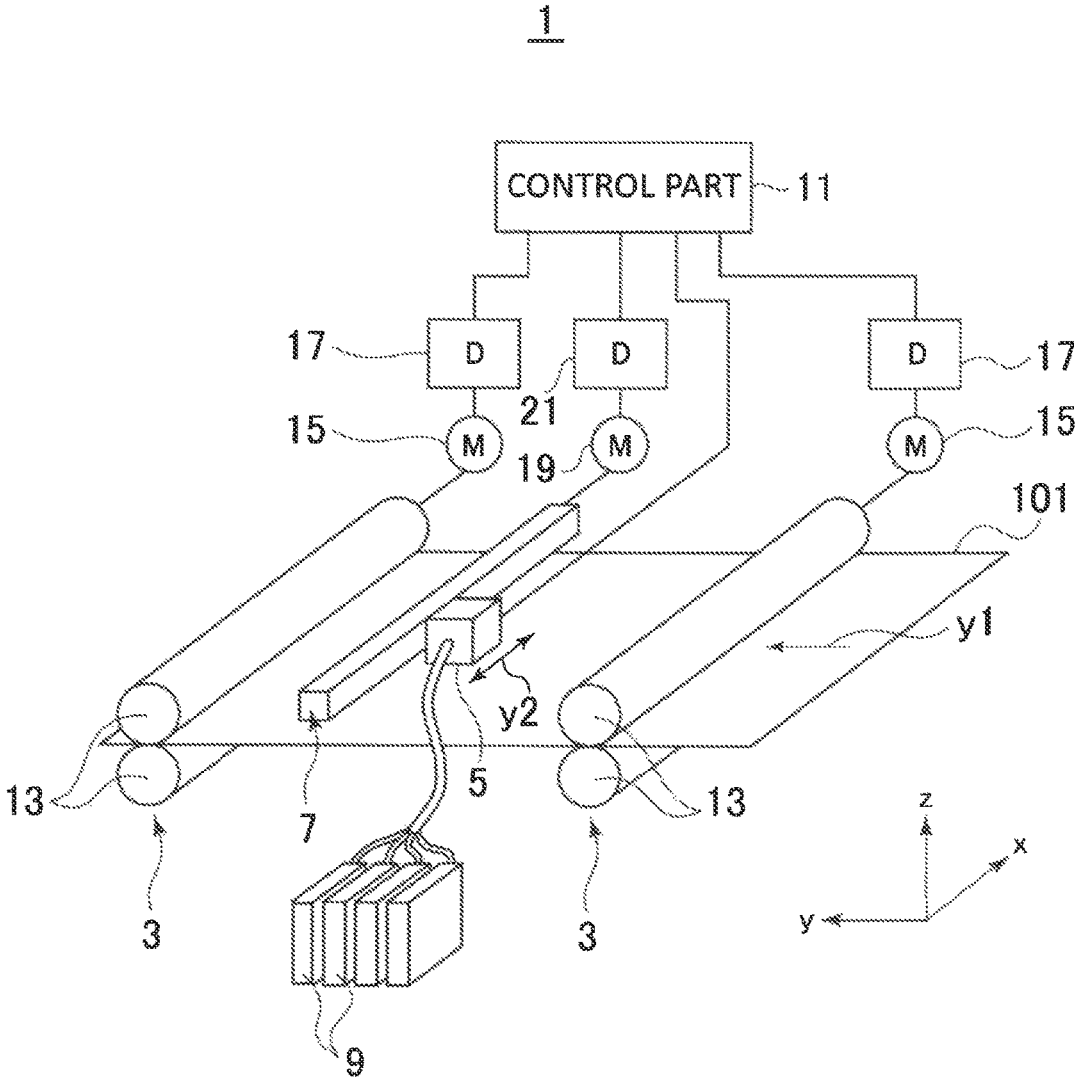
FIG. 1 is a perspective view schematically showing principal parts of a printer according to an embodiment of the present invention.

FIG. 1 is a perspective view schematically showing principal parts of a printer 1 according to an embodiment of the present invention.

The printer 1 is an inkjet head printer. More specifically, for example, the printer 1 is a piezo-head type, serial head type, and off-carriage type color printer. Note that, the printer 1 may realize a color image by a suitable number of colors of inks. However, in the present embodiment, the color image is realized by four colors of inks (black, yellow, magenta, and cyan).

The printer 1 for example has a conveyor 3 which conveys media (for example paper) 101 in a conveyance direction (y-direction) indicated by an arrow y1, a head 5 which ejects ink droplets toward the media 101 (the negative side of the z-direction) being conveyed, a movement device 7 for causing reciprocal movement of the head 5 in a movement direction (arrow y2, x-direction) which is perpendicular to the conveying direction of the media 101, an ink cartridge 9 which supplies ink to the head 5, and a control part 11 which controls the operation of the printer 1 including an ejecting operation of ink from the head 5.

By the reciprocal movement of the head 5 by the movement device 7 while repeatedly ejecting ink droplets from the head 5 to the media 101 in a range extending in the y-direction, strip-shaped two-dimensional images are formed on the media 101. Further, by the media 101 being intermittently conveyed by the conveyor 3, the strip-shaped two-dimensional images are connected and a continuous two-dimensional image is formed on the media 101.

The conveyor 3 for example carries a plurality of media 101 stacked in a not shown supply stack to a not shown discharge stack one by one. The conveyor 3 may be given a known suitable configuration. FIG. 1 illustrates a conveyor 3 which is given a straight path as the conveyance path and has rollers 13 abutting against the media 101, a motor 15 for rotating the rollers 13, and a driver 17 which gives driving power to the motor 15.

The movement device 7 may be given a known suitable configuration. For example, the movement device 7 has a not shown guide rail which supports a not shown carriage so that it can be guided in the movement direction, a not shown belt fixed to the carriage, a not shown pulley upon which the belt is suspended, a motor 19 for rotating the pulley, and a driver 21 which gives driving power to the motor 19.

The ink cartridge 9 is provided in a place different from the head 5 (so that it will not move together with the head 5). The ink cartridge 9 is connected to the head 5 through a flexible tube. A plurality of (four in the present embodiment) ink cartridges 9 are provided corresponding to the number of colors of ink ejected by the head 5.

The control part 11 for example includes a CPU, ROM, RAM, and external memory device. The control part 11 outputs control signals to the driver 17 of the conveyor 3, driver 21 of the movement device 7, and driver (explained later) of the head 5 and controls operations of the conveyor 3, movement device 7, and head 5.

(Fundamental Configuration of Head)

Figure 2:
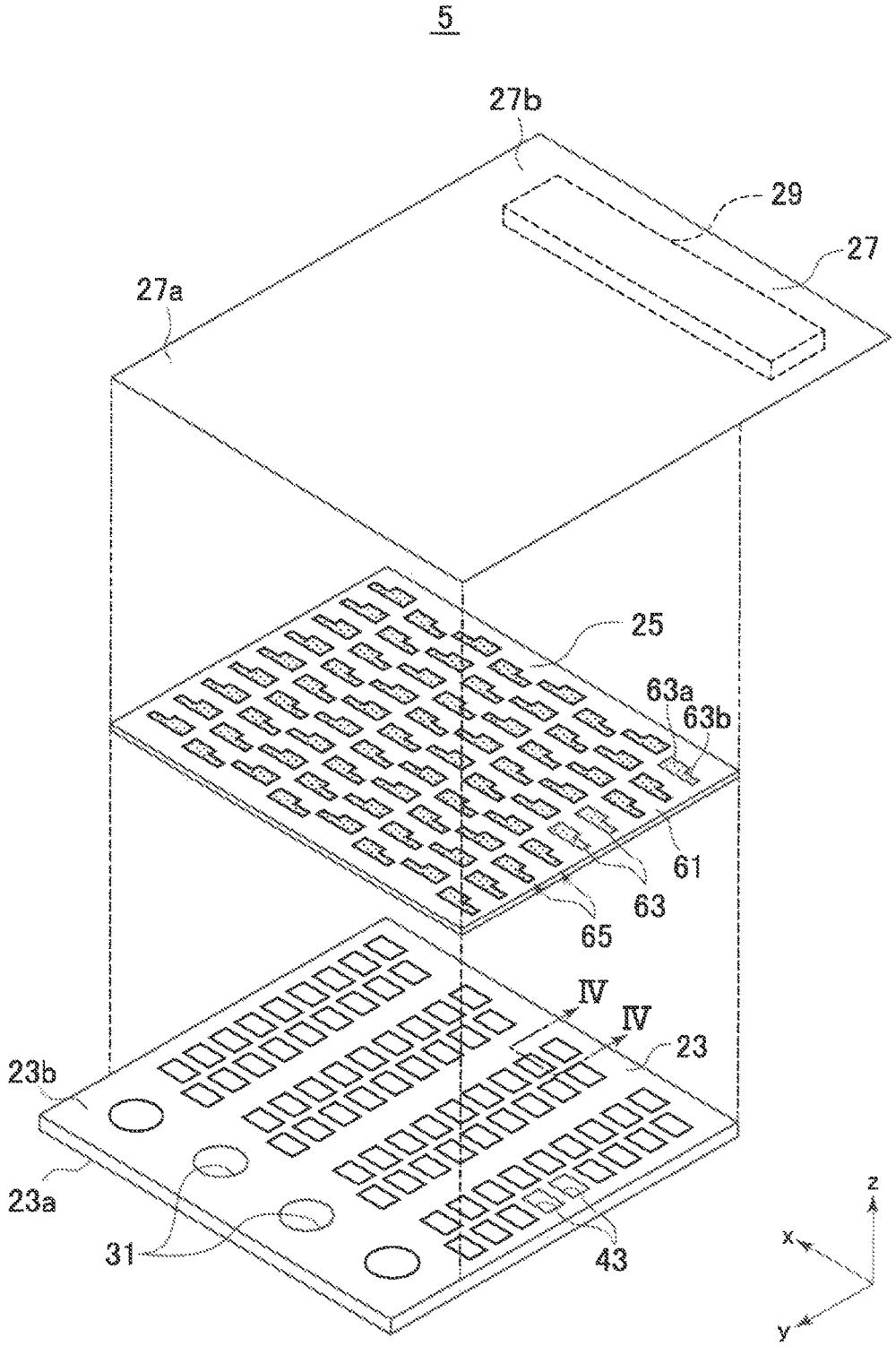
FIG. 2 is a disassembled perspective view schematically showing principal parts of an inkjet head in the printer in FIG. 1.

FIG. 2 is a disassembled perspective view showing a portion of the head 5. Note that, the lower part on the paper in FIG. 2 (negative side of the z-direction) is the media 101 side.

The head 5 has a passageway member 23 configuring passageways of ink, a piezoelectric actuator 25 which generates a driving force for ejecting ink from the passageway member 23, an FPC (flexible printed circuit) 27 which is electrically connected to the piezoelectric actuator 25, and a driver IC 29 which drives and controls the piezoelectric actuator 25 through the FPC 27.

The passageway member 23 is for example substantially formed in a thin box shape and has a first major surface 23*a* which faces the media 101 and a second major surface 23*b* on the back of the same. In the first major surface 23*a*, in order to eject ink droplets, a plurality of nozzles which will be explained later are formed. Further, in the end part of the second major surface 23*b*, an ink supply port 31 through which the ink is supplied is formed for each color.

The piezoelectric actuator 25 is for example substantially formed in a thin box shape and is superimposed on the second major surface 23*b* of the passageway member 23. The piezoelectric actuator 25 is for example formed to a size large enough to cover most of the second major surface 23*b* (portion except area for arranging plurality of ink supply ports 31).

The FPC 27 for example has a facing part 27*a* which covers the piezoelectric actuator 25 and an extending part 27*b* which extends outward from this part toward the outside of the piezoelectric actuator 25. Note that, the extending part 27*b* may extend outward in either of the x-direction or y-direction.

The driver IC 29 is for example mounted on the extending part 27*b* and is mounted on the major surface, between the major surfaces of the FPC 27, which faces the piezoelectric actuator 25 in the facing part 27*a*. Note that, the driver IC 29 may be arranged at a suitable position by folding the FPC 27. Further, two extending parts may be provided in the FPC 27, and the driver IC 29 may be provided on each of the two extending parts (two drivers IC 29 in total may be provided).

Figure 3:
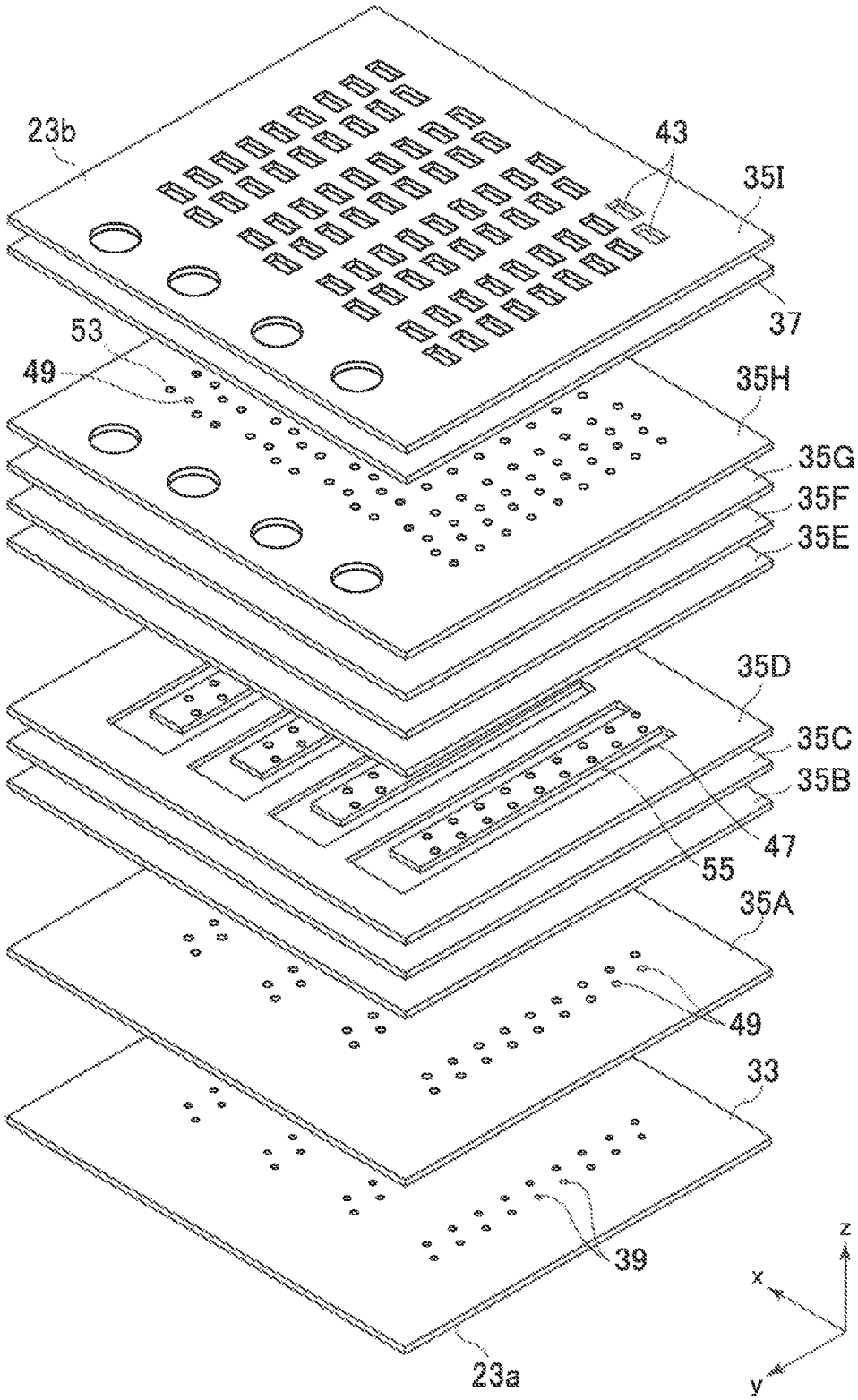
FIG. 3 is a disassembled perspective view schematically showing a passageway member of the inkjet head in FIG. 2.

FIG. 3 is a disassembled perspective view of the passageway member 23.

The passageway member 23 is configured by stacking a plurality of plates. For example, the passageway member 23 has a nozzle plate 33, first metal plate 35A to eighth metal plate 35H, resin plate 37, and ninth metal plate 35I in order from the side facing the media 101 (negative side of the z-direction). Note that, in the following description, sometimes the first metal plate 35A to the ninth metal plate 35I will not be discriminated and will simply be referred to as the "metal plates 35".

In each of these plurality of plates, through holes (49, 53 etc.) are provided. The passageways of ink are formed in the internal portion of the passageway member 23 by communication of these through holes with each other. The passageways may be configured by including grooves which are provided in the plurality of plates and do not penetrate through the plates as well. Note that, the ink supply ports 31 explained above (a portion of the passageways of ink) are configured by the through holes which are formed in the fifth metal plate 35E to ninth metal plate 35I and the resin plate 37.

The material of the metal plates 35 may be a suitable kind of metal. For example, the metal is stainless steel. In the same way, the material of the resin plate 37 may be a suitable kind of resin. For example, the resin is a polyimide resin, polyethylene resin, polypropylene resin, polyvinyl chloride rein, ABS resin, acrylic resin, polyamide resin, or polycarbonate resin. The nozzle plate 33 may be a metal plate or resin plate.

Figure 4:
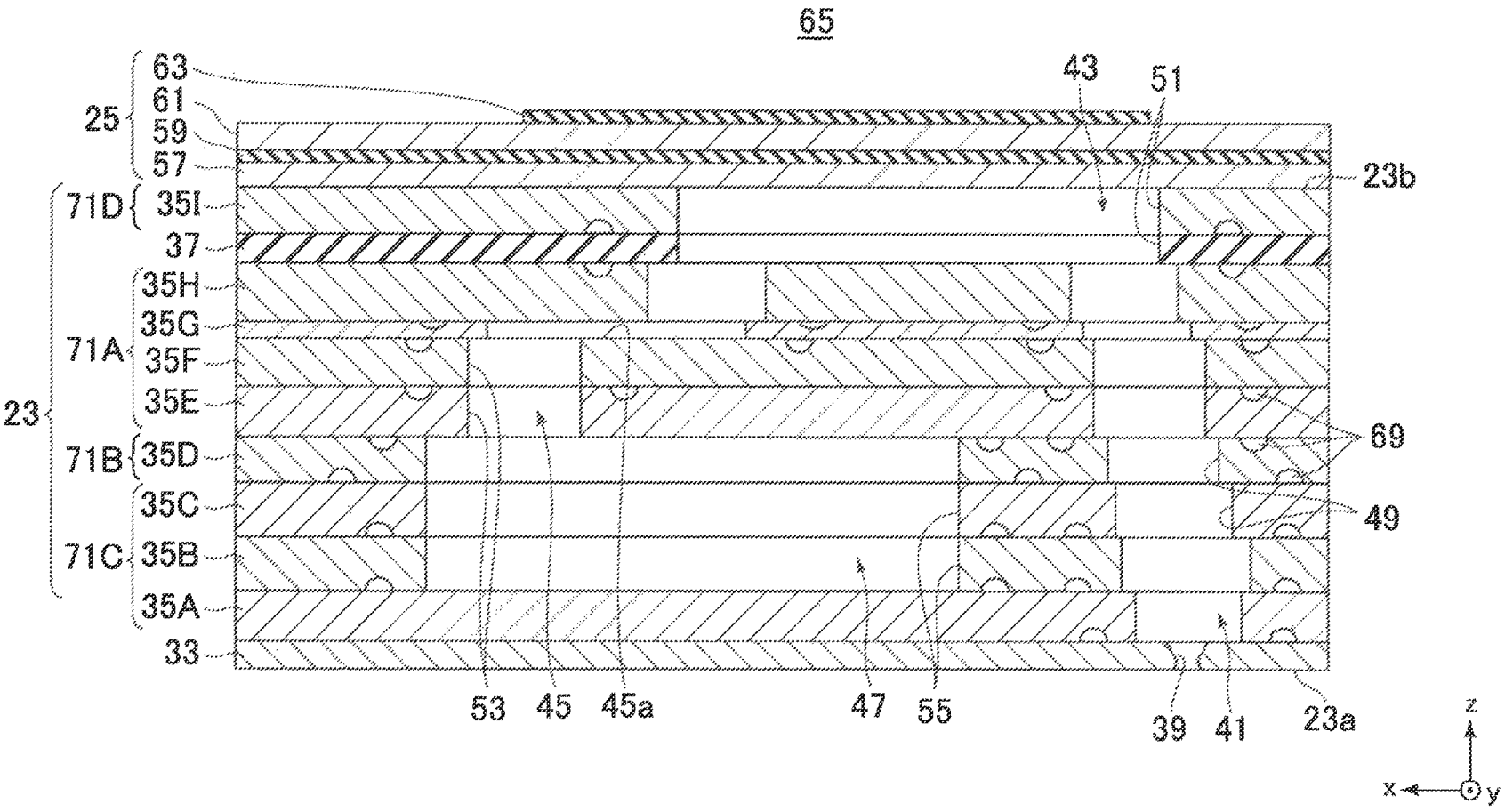
FIG. 4 is a cross-sectional view taken along the line IV-IV in FIG. 2.

FIG. 4 is a cross-sectional view taken along the line IV-IV in FIG. 2.

The passageway member 23 has, as the passageways of ink, for example a plurality of nozzles 39 (see FIG. 3 too) from which the ink is ejected, a plurality of pressure chambers 43 (see FIG. 2 and FIG. 3 too) which are communicated with the plurality of nozzles 39 through a plurality of descenders 41 and are provided for giving the pressure for ejection to the ink, and a common passageway 47 (see FIG. 3 too) which supplies ink to the plurality of pressure chambers 43 through the plurality of communication passages 45 (see FIG. 3 too) to the plurality of pressure chambers 43.

The passageway from a nozzle 39 to a communication passage 45 is a so-called separate passageway and corresponds to 1 dot of the image. For example, as shown in FIG. 2 and FIG. 3, such passageways are arranged in the y-direction in one to four columns (two columns in FIG. 2 and FIG. 3) for each color. A common passageway 47 is provided for each color and for example extends in the direction of arrangement (y-direction) of the separate passageways described above.

Returning to FIG. 4, a nozzle 39 opens at the first major surface 23*a*. A descender 41 for example extends from the nozzle 39 to the second major surface 23*b* side while inclined a little and is connected to the end part of a pressure chamber 43. The pressure chamber 43 is for example formed in a relatively shallow concave shape opening in the second major surface 23*b*. The area of it in a plan view is larger than the cross-sectional areas of the descender 41 and communication passage 45. The communication passage 45 is for example connected to the opposite side to the descender 41 with respect to the pressure chamber 43 and extends from the pressure chamber 43 to substantially the first major surface 23*a* side. The communication passage 45 for example includes a constricted part 45*a* narrowed in its cross-sectional area. The common passageway 47 is for example positioned on the first major surface 23*a* side with respect to the plurality of pressure chambers 43.

Note that, the concrete shapes of these passageways may be suitably set. For example, the planar shape of a pressure chamber 43 may be substantially rectangular having short sides to which the descender 41 and the communication passage 45 are connected, diamond shaped having corner portions to which the descender 41 and the communication passage 45 are connected, or elliptical or oval having semicircular end parts to which the descender 41 and the communication passage 45 are connected. Note that, in the following description, the explanation will be given by taking as an example a pressure chamber 43 having a rectangular planar shape.

The plurality of nozzles 39 are for example configured by through holes provided in the nozzle plate 33. A descender 41 is for example configured by communication of a plurality of descender-use holes 49 which are formed in the first metal plate 35A to eighth metal plate 35H. A pressure chamber 43 is for example configured by communication of pressure chamber-use holes 51 which are formed in the resin plate 37 and ninth metal plate 35I. A communication passage 45 is for example configured by communication of a plurality of communication passage-use holes 53 which are formed in the fifth metal plate 35E to eighth metal plate 35H. A common passageway 47 is for example formed by communication of a plurality of common passage-use holes 55 which are formed in the second metal plate 35B to fourth metal plate 35D.

The actuator 25 is for example configured by a unimorph type piezoelectric actuator substrate and is configured by stacking a vibration plate 57, common electrode 59, piezoelectric substance 61, and plurality of separate electrodes 63 in order from the passageway member 23 side. Note that, they are all formed in layer shapes (plate shapes).

When voltage is applied between the common electrode 59 and a separate electrode 63, the piezoelectric member 61 contracts in the plan direction in mainly the region superimposed on the separate electrode 63 due to an inverse piezoelectric effect. Due to this, the vibration plate 57 warps to the pressure chamber 43 side. By utilization of this operation, pressure is given to the ink inside the pressure chamber 43, and ink droplets are ejected from the nozzle 39.

The vibration plate 57, common electrode 59, and piezoelectric substance 61 are provided over all of the plurality of pressure chambers 43. On the other hand, the separate electrode 63 is provided for each pressure chamber 43. The common electrode 59 is for example given a reference potential. A plurality of separate electrodes 63 are selectively given a potential (driving signal) which is different from that for the common electrode 59. Due to this, ink droplets are selectively ejected from the plurality of nozzles 39.

As shown in FIG. 2, each separate electrode 63 has an electrode body 63*a* which is superimposed on the pressure chamber 43 and is provided for applying voltage to the piezoelectric substance 61 and has an extraction electrode 63*b* for connection with the FPC 27. The electrode body 63*a* for example has a shape substantially the same as (similar to) the planar shape of the pressure chamber 43 and is a bit smaller than a pressure chamber 43. The extraction electrode 63*b* extends outward from the electrode body 63*a* to a suitable direction.

For example, the extraction electrode 63*b* extends outward to the opposite side to the descender 41 and nozzle 39 with respect to the electrode body 63*a* up to a position where it is not superimposed on the pressure chamber 43.

The vibration plate 57 is for example formed by ceramic, silicon oxide, or silicon nitride. The common electrode 59 and separate electrodes 63 are for example formed by silver, platinum, or palladium. The piezoelectric substance 61 is for example formed by ceramic such as PZT (lead zirconate titania).

Note that, in the following description, in the passageway member 23 and piezoelectric actuators 25 shown in FIG. 4, a portion corresponding to one nozzle 39 (substantially the area of arrangement of the pressure chambers 43 and separate electrodes 63 in a plan view) will be sometimes referred to as an "ejection element 65".

(Relief Groove for Adhesive)

Figure 8A:
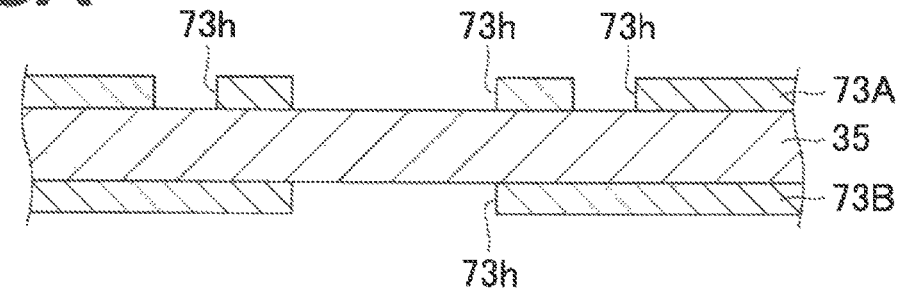
FIG. 8A, FIG. 8B, FIG. 8C and FIG. 8D are schematic cross-sectional views for explaining a method of production of the passageway member.
Figure 8B:
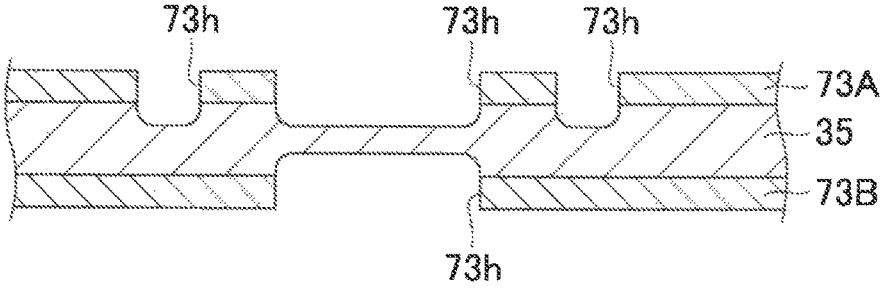
Figure 8C:
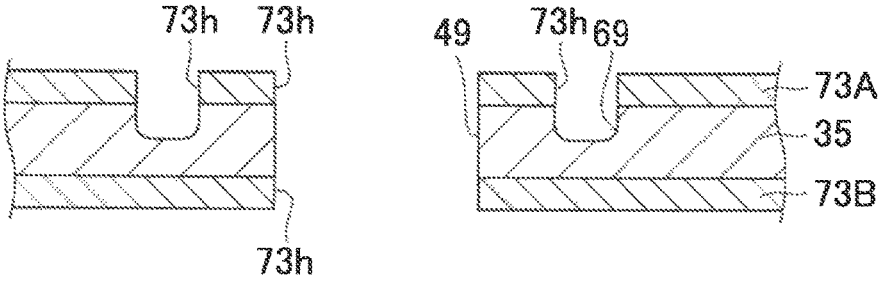
Figure 8D:
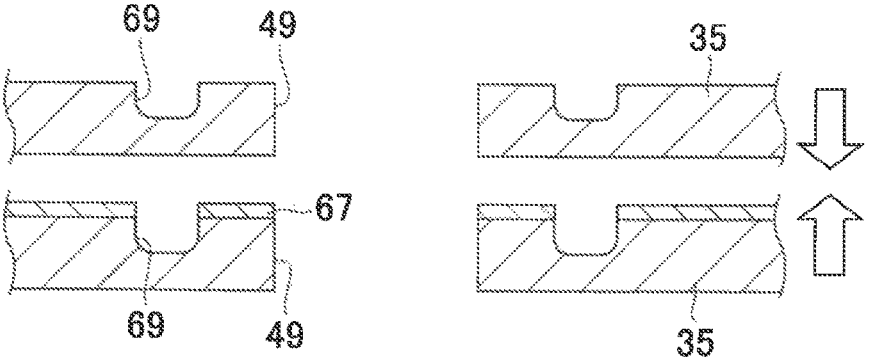

The plurality of plates are fixed to each other by an adhesive 67 between the plates (see FIG. 8D). Further, as shown in FIG. 4, in two or more plates, a plurality of relief grooves 69 are formed in order to allow the excess adhesive 67 to escape.

The relief groove 69 is a concave portion formed in the surface of the plate (in the present application, the term "relief groove" does not include a slit). The cross-sectional shape of the relief groove 69 may be suitably set and is for example a semicircular shape or a rectangular shape having corner portions chamfered. The depth of the relief groove 69 is for example, at the deepest position (usually the center side of the width direction), a half to ⅔ of the thickness of the plate having that relief groove 69 formed therein.

The relief grooves 69 are for example formed in each metal plate 35, but are not formed in the resin plate 37 and nozzle plate 33. However, the relief grooves 69 are arranged among all of plates including the part between the resin plate 37 and the eighth metal plate 35H and the part between the nozzle plate 33 and the first metal plate 35A. Further, the metal plates 35 are configured so that the relief grooves 69 are formed on only one side as much as possible. Specifically, this is as follows.

In the second part 71A configured by one or more metal plates 35 (35H, 35G, 35F, and 35E) which are stacked in order on the surface of the resin plate 37 on the nozzle plate 33 side, the relief grooves 69 are formed on only the resin plate 37 sides in the metal plates 35 (relief grooves 69 are not formed on the nozzle plate 33 sides).

In the first part 71B configured by one or more metal plates 35 (35D) stacked in order on the surface of the second part 71A on the nozzle plate 33 side, the relief grooves 69 are formed in the two surfaces of the metal plates 35 (the surfaces on the resin plate 37 sides and the surfaces on the opposite sides to the former).

In the third part 71C configured by one or more metal plates 35 (35C, 35B, and 35A) which are stacked in order on the surface of the first part 71B on the nozzle plate 33 side, the relief grooves 69 are formed on only the nozzle plate 33 sides in the metal plates 35 (relief grooves 69 are not formed on the resin plate 37 sides). The nozzle plate 33 is adhered to the surface of the third part 71C on the nozzle plate 33 side (directly superimposed).

In the fourth part 71D configured by one or more metal plates 35 (35I) stacked in order on the surface of the resin plate 37 on the opposite side to the nozzle plate 33, the relief grooves 69 are formed on only the resin plate 37 sides in the metal plates 35 (relief grooves 69 are not formed on the opposite sides to the resin plate 37).

The planar shape (route etc.) of a relief groove 69 may be suitably set. Preferably, a relief groove 69 extends so as to surround the through holes configuring a passageway of ink in two plates which face each other while sandwiching that relief groove 69 therebetween. Further, the distance from the through holes is constant. Below, the planar shape of the relief groove 69 will be exemplified.

Figure 5A:
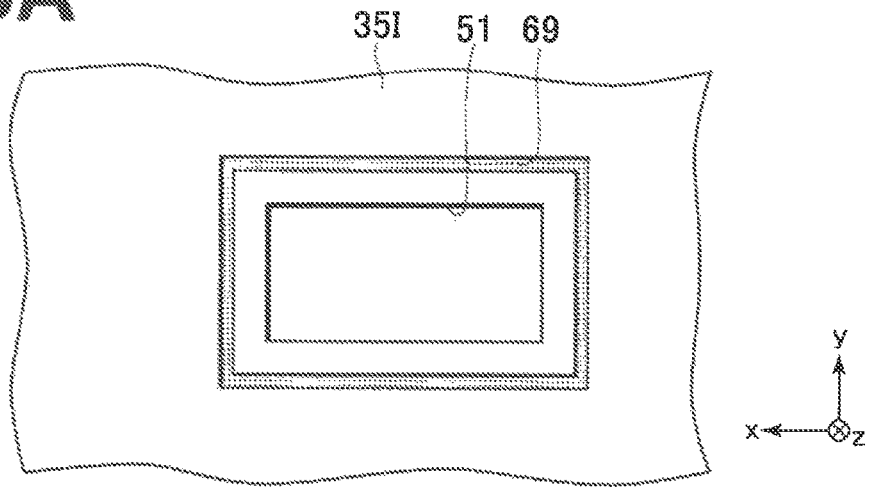
FIG. 5A, FIG. 5B and FIG. 5C show an example of the plate shown in FIG. 4 in a plan view.

FIG. 5A is a plan view showing the surface of the ninth metal plate 35I on the resin plate 37 side in a range equal to that in FIG. 4. This surface is the surface which is adhered to the surface of the resin plate 37 on the opposite side to the nozzle plate 33 (directly superimposed).

In the ninth metal plate 35I, as already explained, a pressure chamber-use hole 51 configuring the pressure chamber 43 is formed. The relief groove 69 in the ninth metal plate 35I for example extends so as to surround the pressure chamber-use hole 51 in the ninth metal plate 35I (and resin plate 37) and is closed. In the ninth metal plate 35I, the relief groove 69 is for example substantially the same shape as the pressure chamber-use hole 51, and the distance from the pressure chamber-use hole 51 is substantially constant. The width of the relief groove 69 is for example constant (true also for the widths of the relief grooves 69 in FIG. 5B to FIG. 6B).

Note that, although not shown, as understood from FIG. 4, the plan view showing the surface of the ninth metal plate 35I on the opposite side to the resin plate 37, the plan view showing the surface of the resin plate 37 on the ninth metal plate 35I side, and the plan view showing the surface of the resin plate 37 on the eighth metal plate 35H side are for example the same as that obtained by omitting the relief groove 69 from FIG. 5A.

Figure 5B:
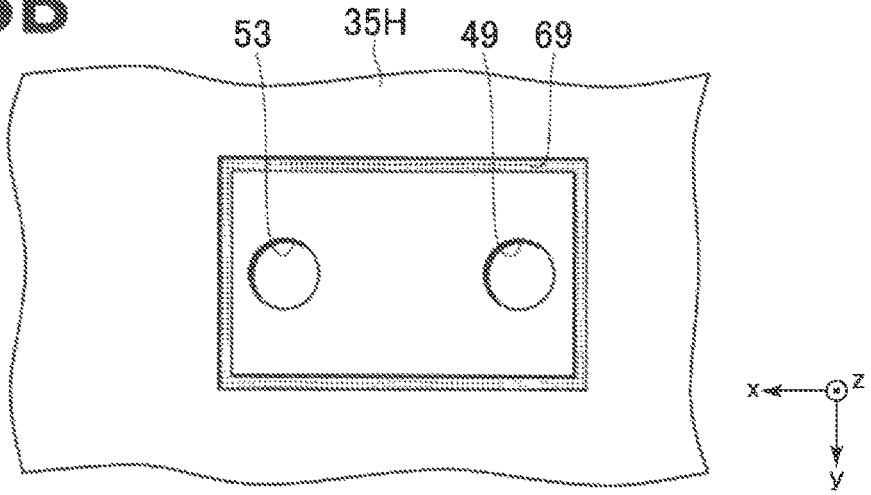

FIG. 5B is a plan view showing the surface of the eighth metal plate 35H on the resin plate 37 side in a range equal to that in FIG. 4. This surface is the surface adhered to the surface of the resin plate 37 on the nozzle plate 33 side (directly superimposed).

In the eighth metal plate 35H, as already explained, a descender-use hole 49 configuring a descender 41 and a communication passage-use hole 53 configuring a communication passage 45 are formed. The relief groove 69 in the eighth metal plate 35H for example extends so as to surround both of the descender-use hole 49 and the communication passage-use hole 53 of the eighth metal plate 35H and is closed. Further, this relief groove 69 surrounds also the pressure chamber-use hole 51 in the resin plate 37 as understood from FIG. 4.

A more concrete shape of the relief groove 69 in the eighth metal plate 35H which surrounds both of the descender-use hole 49 and the communication passage-use hole 53 may be suitably set. The relief groove 69 in the eighth metal plate 35H and the relief groove 69 in the ninth metal plate 35I may be superimposed or not superimposed on each other in a plan view.

Note that, although not shown, as understood from FIG. 4, the plan view showing the surface of the eighth metal plate 35H on the nozzle plate 33 side is for example the same as that obtained by omitting the relief groove 69 from FIG. 5B.

Figure 5C:
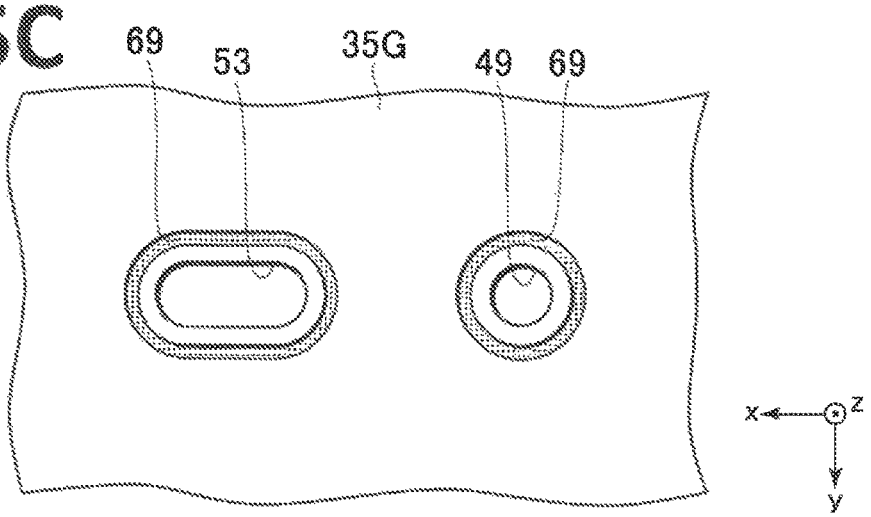

FIG. 5C is a plan view showing the surface of the seventh metal plate 35G on the resin plate 37 side in a range equal to that in FIG. 4.

In the seventh metal plate 35G, as already explained, a descender-use hole 49 configuring a descender 41 and a communication passage-use hole 53 configuring a communication passage 45 are formed. In the seventh metal plate 35G, a relief groove 69 is for example provided corresponding to each of the descender-use hole 49 and the communication passage-use hole 53. Each relief groove 69 for example extends so as to surround the descender-use hole 49 or communication passage-use hole 53 (individually) and is closed. Note that, the relief grooves 69 in the seventh metal plate 35G individually surround also the descender-use hole 49 and the communication passage-use hole 53 in the eighth metal plate 35H.

More concrete shapes of the relief groove 69 surrounding the descender-use hole 49 and the relief groove 69 surrounding the communication passage-use hole 53 in the seventh metal plate 35G may be suitably set. For example, the relief groove 69 surrounding the descender-use hole 49 is substantially the same in shape as the descender-use hole 49, and the distance from the descender-use hole 49 is substantially constant. In the same way, for example, the relief groove 69 surrounding the communication passage-use hole 53 is substantially similar to the communication passage-use hole 53, and the distance from the communication passage-use hole 53 is substantially constant. The relief groove 69 surrounding the descender-use hole 49 and the relief groove 69 surrounding the communication passage-use hole 53 may be connected to each other by a not shown relief groove 69 which extends in the x-direction as well.

Note that, although not shown, as understood from FIG. 4, each of the plan views showing the surfaces of the sixth metal plate 35F and fifth metal plate 35E on the resin plate 37 side becomes one having a descender-use hole 49, relief groove 69 surrounding this, communication passage-use hole 53, and relief groove 69 surrounding this formed therein in the same way as FIG. 5C, although details of shapes and dimensions are different from those in FIG. 5C. Further, the relief groove 69 in each surface surrounds also the descender-use hole 49 or communication passage-use hole 53 in the surface adhered to each surface. The plan view showing the surface of the seventh metal plate 35G on the nozzle plate 33 side for example becomes that obtained by omitting the relief groove 69 from FIG. 5C. Also the plan views showing the surfaces of the sixth metal plate 35F and fifth metal plate 35E on the nozzle plate 33 side are the same.

Figure 6A:
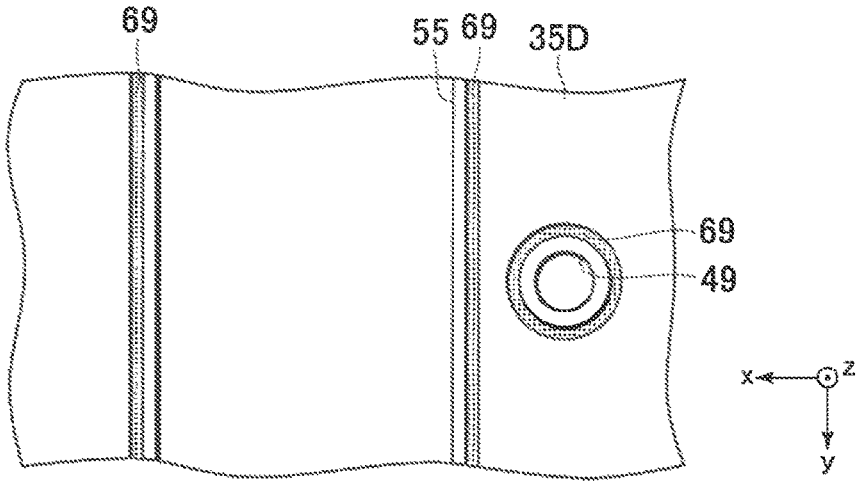
FIG. 6A and FIG. 6B show another example of the plate shown in FIG. 4 in a plan view.

FIG. 6A is a plan view showing the surface of the fourth metal plate 35D on the resin plate 37 side in a range equal to that in FIG. 4.

In the fourth metal plate 35D, as already explained, a descender-use hole 49 configuring a descender 41 and a common passage-use hole 55 configuring a common passageway 47 are formed. In the surface shown in FIG. 6A, a relief groove 69 is for example provided corresponding to each of the descender-use hole 49 and common passage-use hole 55. The shape of the relief groove 69 corresponding to the descender-use hole 49 is for example the same as that of the relief groove 69 explained with reference to FIG. 5C. The shape of the relief groove 69 corresponding to the common passage-use hole 55 will be explained later. Note that, the relief groove 69 surrounding the descender-use hole 49 and the relief groove 69 provided corresponding to the common passage-use hole 55 may be connected to each other by a not shown relief groove 69 extending in the x-direction as well.

Figure 6B:
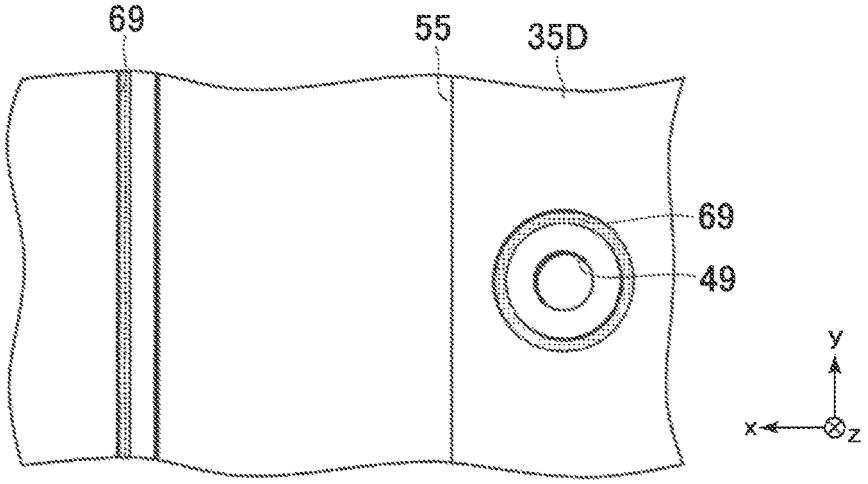

FIG. 6B is a plan view showing the surface of the fourth metal plate 35D on the nozzle plate 33 side in a range equal to that in FIG. 4. That is, FIG. 6B shows the back surface of the surface shown in FIG. 6A.

In the fourth metal plate 35D, as already explained, a relief groove 69 is formed in the two surfaces, therefore a relief groove 69 is formed also in the surface shown in FIG. 6B. Relief grooves 69 are, for example, in the same way as the surface shown in FIG. 6A, provided corresponding to each of the descender-use hole 49 and common passage-use hole 55. The shape of the relief groove 69 provided corresponding to the descender-use hole 49 is for example the same as that of the relief groove 69 explained with reference to FIG. 5C. Further, in the same way as FIG. 6A, it may be connected to a relief groove 69 provided corresponding to the common passage-use hole 55 as well.

Note, in a plane perspective, the relief groove 69 which is shown in FIG. 6B and corresponds to the descender-use hole 49 is not superimposed with the relief groove 69 which is shown in FIG. 6A and corresponds to the descender-use hole 49 (see FIG. 4 too). For example, the relief groove 69 in FIG. 6B is positioned on the outer circumferential side from the relief groove 69 in FIG. 6A. For the relief groove 69 corresponding to the common passage-use hole 55 as well, the relief groove 69 in FIG. 6A and the relief groove 69 in FIG. 6B are not superimposed as will be explained in detail later.

Figure 7A:
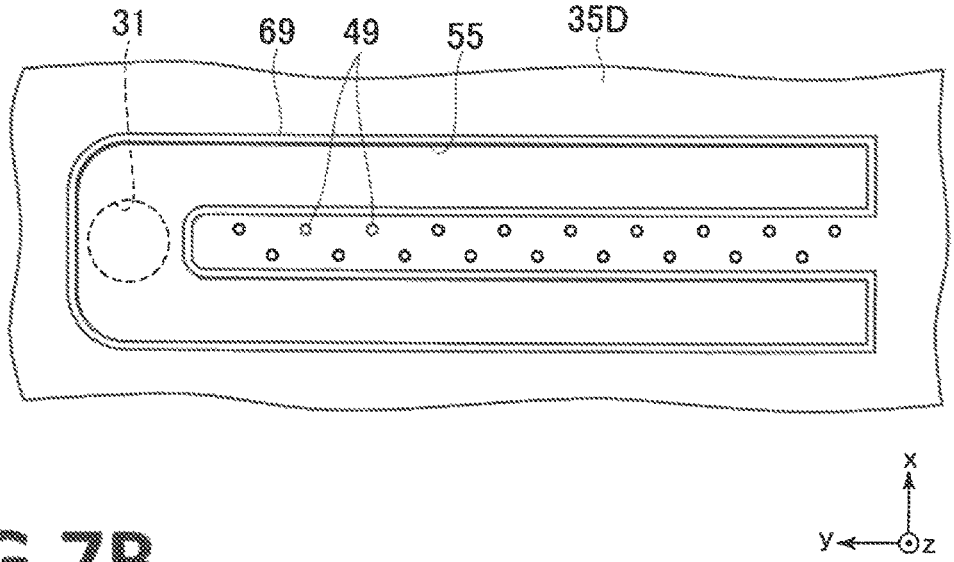
FIG. 7A and FIG. 7B are plan views of a broader range of the plate shown in FIG. 6A and FIG. 6B.

FIG. 7A is a plan view showing the surface of the fourth metal plate 35D on the resin plate 37 side in a range corresponding to one color of ink. That is, FIG. 7A shows the surface shown in FIG. 6A in a broader range than that in FIG. 6A.

Note that, in this figure, the relief groove 69 corresponding to the common passage-use hole 55 is indicated by a line, and illustration of the relief groove 69 corresponding to the descender-use hole 49 is omitted. Further, in this figure, the ink supply port 31 is indicated by a dotted line. This is true also for FIG. 7B which will be explained later.

The common passage-use hole 55 (common passageway 47), for example, is branched from the ink supply port 31 into two and extends in the y-direction corresponding to the fact that ejection elements 65 (FIG. 4) are arranged in two columns in the y-direction for one ink supply port 31. From another viewpoint, the common passage-use hole 55 is "U-shaped". Between the branched portions of the common passage-use hole 55, two columns of descender-use holes 49 corresponding to the two columns of ejection elements 65 are arranged.

In FIG. 7A, the relief groove 69 for example extends along the entire edge part of the common passage-use hole 55 and is closed. Accordingly, this relief groove 69 surrounds the common passage-use hole 55 (separately from the descender-use holes 49). Note that, this relief groove 69 surrounds also a plurality of communication passage-use holes 53 in the metal plate 35E which is adhered to the surface shown in FIG. 7A. The shape of the relief groove 69 is for example substantially the same as the shape of the edge part of the common passage-use hole 55, and the distance between the relief groove 69 and the common passage-use hole 55 is substantially constant.

Figure 7B:
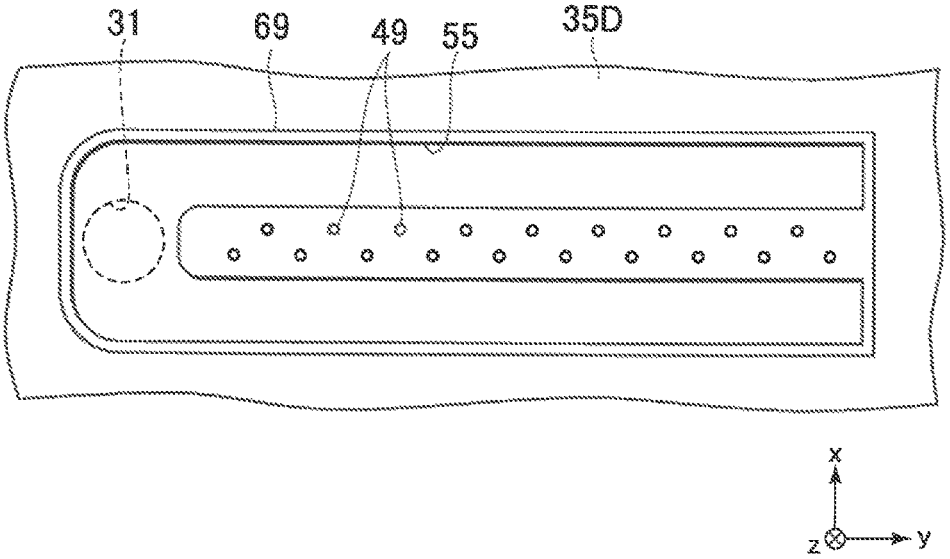

FIG. 7B is a plan view showing the surface of the fourth metal plate 35D on the nozzle plate 33 side in a range corresponding to one color of ink. That is, FIG. 7B shows the back surface of the surface shown in FIG. 7A.

In FIG. 7B, the relief groove 69 for example extends along the edge part on the outside of the "U-shape" of the common passage-use hole 55, is connected on the opening side of the "U-shape", and closed. Accordingly, this relief groove 69 surrounds the common passage-use hole 55 together with the descender-use holes 49. Note that, this relief groove 69 surrounds also the common passage-use hole 55 and descender-use holes 49 in the third metal plate 35C adhered to the surface shown in FIG. 7B. In this relief groove 69, the shape of the portion along the edge part on the outside of the "U-shape" of the common passage-use hole 55 is for example substantially the same as the shape of the edge part of the common passage-use hole 55, and the distance between the relief groove 69 and the common passage-use hole 55 is substantially constant.

As already explained, the relief grooves 69 in the two surfaces of the fourth metal plate 35D are not superimposed over each other. For example, the relief groove 69 shown in FIG. 7B is positioned on outer circumferential side from the relief groove 69 shown in FIG. 7A.

Note that, although not shown, the plan views of the third metal plate 35C and second metal plate 35B on the nozzle plate 33 side are for example the same as the plan views shown in FIG. 6A and FIG. 7A although details of their shapes and dimensions are different. The plan views of the back surfaces thereof are the same as those obtained by omitting the relief grooves 69 from the plan views described above. The plan view of the first metal plate 35A on the resin plate 37 side is for example the same as that obtained by omitting the communication passage-use hole 53 and the relief groove 69 surrounding this from FIG. 5C although details of its shape and dimensions are different. The plan view of the back surface thereof is the same as that obtained by further omitting the relief groove 69 from the plan view described above.

(Method of Production of Passageway Member)

FIG. 8A to FIG. 8D are schematic cross-sectional views for explaining one example of the method of production of the passageway member 23.

First, as shown in FIG. 8A, on the two surfaces of a metal plate 35, a first mask 73A and second mask 73B (hereinafter, sometimes the two will not be distinguished and will only be referred to as the "masks 73") made of resist are formed by photolithography. In each mask 73, openings 73*h* are formed in areas where the metal plate 35 must be etched. Among the plurality of openings 73*h*, there are those superimposed on each other between the two masks 73 and those which are not superimposed on each other.

Next, as shown in FIG. 8B, an etching solution is made to contact the metal plate 35 through the openings 73*h* and so on to thereby etch the metal plate 35 from the two surfaces. Due to this, in the two surfaces of the metal plate 35, concave portions are formed at the positions where they are superimposed on the openings 73*h*. Note that, the speeds of etching in the two surfaces are for example equal to each other.

When etching advances, as shown in FIG. 8C, in the openings 73*h* superimposed on each other between the two masks 73, the concave portions formed in the two surfaces by etching are connected to each other and therefore become through holes (for example descender-use hole 49). Further, by ending the etching at a suitable timing after the formation of the through holes, at the openings 73*h* formed only in one mask 73 (first mask 73A in FIG. 8), the concave portions formed by etching still remain as concave portions as they are and consequently become relief grooves 69.

In this way, in the present embodiment, by performing etching from the two surfaces by using two types of masks 73, half etching for the relief grooves 69 can be carried out simultaneously with the formation of the through holes. Accordingly, it is not necessary to separately perform the formation of the through holes and the formation of the relief grooves 69, therefore the manufacturing cost is reduced. Note that, the method of forming a through hole in a plate in which only a through hole is formed and which does not need half etching may be an etching of both sides in the same way as that described above or one side etching unlike the above description or may be a method other than etching.

After the formation of the through holes and relief grooves 69, as shown in FIG. 8D, the plurality of plates (33, 35, and 37) are bonded by the adhesive 67.

Specifically, first, the adhesive 67 is coated on the plates. The adhesive 67 may be coated on either of the surface having a relief groove 69 formed therein and the surface not formed with a relief groove 69. Further, the adhesive 67 is for example coated on the entire surface of the plate. From another viewpoint, it is coated on the two lateral sides of the relief groove 69. Note, as shown in FIG. 8D, preferably the adhesive 67 is not coated on the relief groove 69. The adhesive 67 is basically coated with a constant thickness. As the coating method of the adhesive 67, for example a known method may be utilized such as the adhesive coated on the film being transferred to the metal plate 35 or screen printing being used. Further, the adhesive 67 is for example an epoxy resin or other thermosetting resin.

Next, the plate on which the adhesive 67 is coated and the plate to be adhered to this plate are superimposed on each other and are heated and pressed. Note that, heating and pressing may be carried out after superimposing all plates configuring the passageway member 23 or may be carried out for each portion of the passageway member 23 and then carried out as a whole.

At the thermosetting, the excess adhesive 67 flows into the relief grooves 69. Due to this, the probability of flow of the excess adhesive 67 into the passageways of ink and the amount of flow are reduced. Consequently, the probability of increase or variation of the resistance values of the ink passageways is reduced.

As described above, in the present embodiment, the head 5 has the passageway member 23 which is configured by a plurality of plates (33, 35, and 37) stacked through the adhesive 67 and in which the ink passageways (39, 41, 43, 45, and 47) are configured by communication of the through holes (39, 49, 51, 53, and 55) individually formed in the plurality of plates to each other. The plurality of plates include the resin plate 37 and two or more metal plates 35. The resin plate 37 does not have a relief groove 69 for the adhesive 67. The plurality of metal plates 35 include the eighth metal plate 35H and/or ninth metal plate 35I which is adhered to the resin plate 37 and has the relief groove 69 for the adhesive 67 on the resin plate 37 side.

Accordingly, concerning adhesion of the resin plate 37 and the metal plates 35, the relief grooves 69 are formed only in the metal plates 35 for which high precision half etching can be easily realized cheaply. The "cheap half etching" referred to here is for example etching from the two sides by utilizing two types of masks 73 as explained with reference to FIG. 8. Then, since the relief grooves 69 can be cheaply formed, a head capable of printing a high quality image can be cheaply realized by reduction of the excess adhesive 67 flowing into the passageways of ink. Further, for example, since the relief groove 69 is not formed in the resin plate 37 having a lower strength than the metal plate 35, improvement of strength for the entire passageway member 23 is expected.

Further, in the present embodiment, the plurality of metal plates 35 include the eighth metal plate 35H which is adhered to one surface of the resin plate 37 and has relief grooves 69 for the adhesive 67 on the resin plate 37 side and the ninth metal plate 35I which is adhered to the other surface of the resin plate 37 and has relief grooves 69 for the adhesive 67 on the resin plate 37 side.

That is, the resin plate 37 is not the plate in the lowermost layer or uppermost layer of the passageway member 23. In order to position the relief grooves 69 in each part between two or more plates, usually the relief grooves 69 are formed on at least one side of the plates which are not the plate in the lowermost layer or uppermost layer. However, by not forming the relief grooves 69 on both sides of the resin plates 37 which are not the plate in the lowermost layer or uppermost layer, as explained above, the cost can be reduced. That is, in the present embodiment, the cost is reduced by a specific arrangement of relief grooves 69 in the stacking direction.

Further, in the present embodiment, the plurality of metal plates 35 include one or more metal plates 35 (ninth metal plate 35I) which are stacked in order on one surface of the resin plate 37 and have the relief grooves 69 for the adhesive 67 on only the resin plate 37 sides and one or more metal plates 35 (fifth metal plate 35E to eighth metal plate 35H) which are stacked in order on the other surface of the resin plate 37 and have the relief grooves 69 for the adhesive 67 on only the resin plate 37 sides.

That is, the directions of the surfaces having the relief grooves 69 formed therein are reversed when sandwiching the resin plate 37 therebetween. Due to this, the relief grooves 69 of the metal plates 35 are positioned on the two sides of the resin plate 37, while the resin plate 37 is not formed with a relief groove 69. Further, in each metal plate 35, the relief grooves 69 are formed on only one side. Since the relief grooves 69 are formed on only one side, unlike the case of forming relief grooves 69 on both sides, it is not necessary to avoid a situation the relief grooves 69 on both sides being superimposed on each other to become through holes. As a result, for example, the degree of freedom of patterns and depths of the relief grooves 69 is improved.

Further, in the present embodiment, the plurality of plates include a nozzle plate 33 having nozzles. The plurality of metal plates 35 include a second part 71A configured by one or more metal plates 35 (fifth metal plate 35E to eighth metal plate 35H) which are stacked in order on the surface of the resin plate 37 on the nozzle plate 33 side and have relief grooves 69 for the adhesive 67 only on the resin plate 37 side, the first part 71B configured by one or more metal plates 35 (fourth metal plate 35D) which are stacked in order on the surface of the second part 71A on the nozzle plate 33 side and have the relief grooves 69 for the adhesive 67 on both sides, and the third part 71C configured by one or more metal plates 35 (first metal plate 35A to third metal plate 35C) which are stacked in order on the surface of the first part 71B on the nozzle plate 33 side and have the relief grooves 69 for the adhesive 67 on only the nozzle plate 33 side. The nozzle plate 33 is adhered to the surface of the third part 71C on the nozzle plate 33 side and does not have a relief groove 69 for the adhesive 67.

Accordingly, for example, it is not necessary to form a relief groove 69 in the nozzle plate 33 in addition to the resin plate 37. As a result, for example, the nozzle plate 33 can be configured even by a resin plate for which half etching is difficult to perform cheaply. That is, the degree of freedom for selection of material for the nozzle plate 33 is improved. Further, in each metal plate 35 in the second part 71A and third part 71C, the relief grooves 69 are formed on only one side. Therefore, for example, as explained above, the degree of freedom of patterns and depths of the relief grooves 69 is improved. In the metal plate 35 in the first part 71B, for example, although the strength falls due to the formation of the relief grooves 69 on both sides, it is reinforced since it is not adhered to the resin plate 37 or nozzle plate 33 and is nipped between the second part 71A and the third part 71C configured by the metal plates 35.

A nozzle 39 has a large influence upon the ejection characteristic of the ink compared with another passageway, therefore the necessity of forming this with a higher precision than that for another passageway is high. The machining accuracy by etching is relatively low. Therefore, even in a case where the nozzle plate 33 is configured by metal, the nozzle 39 is for example formed by punching or formed by patterning when preparing the nozzle plate 33 by electrocasting. In such a process, when forming the nozzles 39, it is difficult to form the relief grooves 69, therefore design for making the formation of relief groove 69 in the nozzle plate 33 unnecessary is preferred.

Further, in the present embodiment, in the metal plate 35 (fourth metal plate 35D) of the first part 71B, the relief groove 69 on the resin plate 37 side and the relief groove 69 on the nozzle plate 33 side are not superimposed on each other.

Accordingly, it is not necessary to form a shallow relief groove 69 in order to avoid penetration of the relief grooves 69 on both sides, therefore the degree of freedom of depth of the relief groove 69 is high. As a result, for example, the relief groove 69 can be cheaply formed by utilizing the etching method explained with reference to FIG. 8.

Further, in the present embodiment, the resin plate 37 is the plate of configuring the side walls of the pressure chamber (pressure chamber-use hole 51).

The resin used for the resin plate 37 has for example large flexibility when compared with the metal used for the metal plates 35. For this reason, by forming the plate (37) for configuring the pressure chamber-use hole 51 as the resin plate, displacement of the piezoelectric actuator 25 can be made large.

(Modification)

Figure 9:
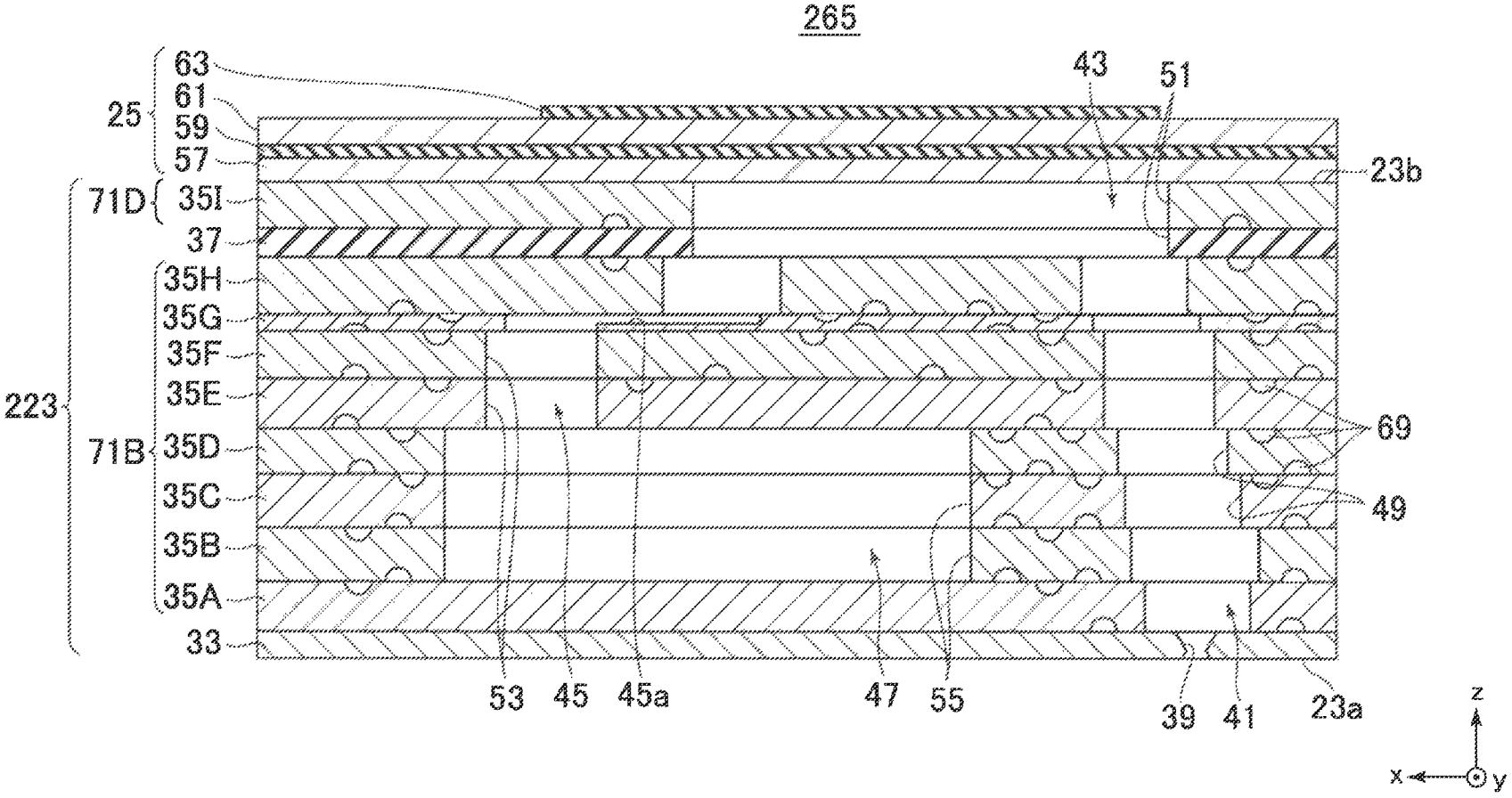
FIG. 9 is a cross-sectional view showing a portion of the passageway member according to one modification.

FIG. 9 is a cross-sectional view showing a passageway member 223 (ejection element 265) according to a modification and corresponding to FIG. 4.

As shown in this modification, the second part 71A having the relief grooves 69 on only the nozzle plate 33 side and/or the third part 71C having the relief grooves 69 on only the resin plate 37 side need not be provided if it is not necessary. That is, the second part 71A need not be stacked on the resin plate 37 on the nozzle plate 33 side, and the first part 71B may be directly stacked. In the same way, on the nozzle plate 33, the third part 71C need not be stacked, and the first part 71B may be directly stacked on the resin plate 37 side.

Further, as already explained, the passageways of the passageway member 223 may include grooves (recessed grooves) which are provided in the plates (33, 35, and/or 37) and do not penetrate as well. FIG. 9 illustrates as an example a case where a constricted part 45*a* is formed by including a recessed groove provided in the seventh metal plate 35G. Such a recessed groove is formed by for example half etching.

Figure 10:
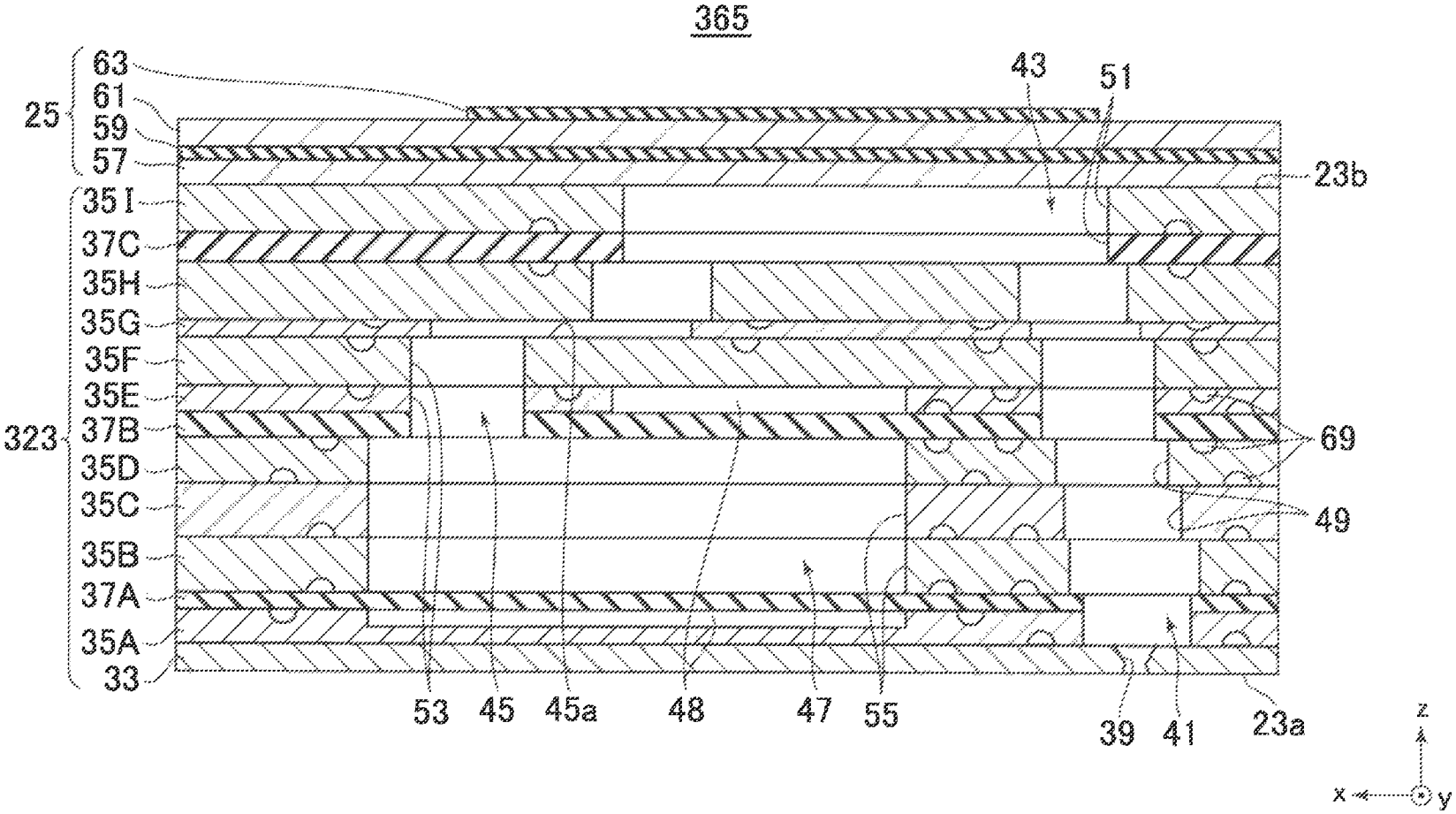
FIG. 10 is a cross-sectional view showing a portion of the passageway member according to another modification.

FIG. 10 is a cross-sectional view showing a passageway member 323 (ejection element 365) according to another modification and corresponding to FIG. 4.

As shown in this modification, the resin plate may be used not only for the plate (third resin plate 37C) configuring the pressure chamber-use hole 51, but also for example the plates (first resin plate 37A and second resin plate 37B) configuring the upper surface and/or lower surface (two in the illustrated example) of the common passageway 47.

As described above, in general, the resin configuring the resin plate has a high flexibility compared with the metal configuring the metal plate. Therefore, by forming the plates configuring the upper and lower surfaces of the passageway as resin plates as illustrated, a damper attenuating vibration of liquid in the passageway can be configured. Preferably, in order to make the action of the damper better, as illustrated, in the plates (37A, 37B) which act as dampers, the surfaces which are positioned on the side opposite to the surfaces facing the passageway (47) are made face the damper chambers 48 which are voids provided in plates or the like. Inside the damper chamber 48, for example, ink may be arranged by communication with the separate passageways or common passageway or gas may be sealed.

Further, the vibration of the passageway member 323 caused by vibration applied from the piezoelectric actuator 25 can be suppressed only when a portion of the passageway member 323 is simply a resin plate. As in the illustrated example, if there are a plurality of resin plates (37A to 37C) which are not continuously stacked, each plate suppresses the vibration at a different position in the passageway member 323, therefore the vibration can be more effectively suppressed.

The present invention is not limited to the above embodiment and may be worked in various ways.

For example, the printer (inkjet head) is not limited to a piezo-head type, serial head type, and off-carriage type color printer. For example, the printer may be a thermal head type, line head type, and/or on-carriage type or may not be a color printer. Also the configurations of the sections other than the inkjet head in the printer (for example the conveyor of media) may be suitable configurations other than the illustrated configurations. The media is not limited to paper and may be metal or resin as well.

The numbers and thicknesses of the plates are not limited to those exemplified in the embodiment and may be suitably set in accordance with the shape etc. of the ink passageway. Two or more resin plates other than the nozzle plate may be disposed. In the embodiment, the pressure chambers opened on the piezoelectric actuator side, but the passageway member may have a plate closing the pressure chambers as well. Note that, this plate closing the pressure chambers may be used also as the vibration plate of the piezoelectric actuator. The relative positional relationships among the shapes of the ink passageways, position of the resin plate in the stacking direction, and the position in the stacking direction of the metal plate having relief grooves formed on both sides may be suitably set as well.

In the embodiment, as the relief grooves, ones surrounding the through holes configuring separate passageways (nozzles, descenders, pressure chambers, and communication passages) individually or together or ones surrounding the common passageway corresponding to one color of ink separately from the separate passageways or together with the separate passageways were exemplified. However, the relief groove is not limited to the same. For example, the relief groove may be one surrounding the common passageway and/or separate passageways corresponding to two or more colors of inks and need not be closed. Further, the relief grooves may be ones vertically and horizontally formed in mesh. The relief grooves may be changed in width as well.

The resin plate may be used for any of the plurality of plates configuring the passageway member. That is, although the aspects of configuring the side walls of the pressure chamber-use hole and upper and lower surfaces of the common passageway by the resin plates were illustrated in the embodiment and modifications, the method of utilization of the resin plate is not limited to this. As already explained, even if a portion of the passageway member (23 etc.) is simply a resin plate, the effect capable of suppressing the vibration of the passageway member caused by the vibration added from the piezoelectric actuator (25) and other effects can be exerted.

In the embodiment, the plate (37) configuring the lower side of the pressure chamber-use hole (51) was formed as the resin plate. In place of this or in addition to this, the plate (35I) configuring the upper side of the pressure chamber-use hole may be formed as a resin plate as well. The entire pressure chamber-use hole may be configured by one resin plate as well. The pressure chamber-use hole may be configured by three or more plates including one or more resin plates as well. In any case, for example, by utilizing the fact that the resin used in the resin plate has a large flexibility compared with the metal used in the metal plate, the displacement of the piezoelectric actuator can be made large. The passageway having the upper and lower surfaces configured by the resin plate is not limited to the common passageway, but may be separate passageways as well.

Further, in the resin plate, if simply forming through holes which are circular and have small diameters, the holes can be easily formed by laser or punching, also the precision of dimensions of the through holes can be made higher than that formed by etching metal plates. For this reason, preferably the nozzle plate etc. are formed as the resin plates.

The resin plate is not limited to a plate to which metal plates are adhered on both sides. That is, the resin plate may be a plate at the uppermost layer or lowermost layer as well.

A metal plate to be adhered to the resin plate may have relief grooves not only on the resin plate side, but also on the side opposite to the resin plate.

Further, a suitable number of metal plates having relief grooves on both sides may be provided at suitable positions. For example, relief grooves may be formed on both sides of all of the metal plates (except the case where it is the uppermost layer or lowermost layer). Further, for example, in the same way as the embodiment, in the case where the relief grooves are formed on only one side as much as possible in the plurality of metal plates between the resin plate and the nozzle plate, the relief grooves may be formed on both sides of a metal plate adhered to the resin plate and the relief grooves may be formed only on the nozzle plate side in the other metal plates, or the relief grooves may be formed on both sides of a metal plate adhered to the nozzle plate and the relief grooves may be formed only on the resin plate side in the other metal plates.

Further, the relief grooves may be formed on only one side as well in all of the metal plates. For example, the nozzle plate may also be configured by a metal plate and the relief grooves may be formed on the resin plate side in all of the metal plates (including the nozzle plate) stacked on the surface of the resin plate on the nozzle plate side and the relief grooves may be formed on the resin plate side in all of the metal plates which are stacked on the surface of the resin plate on the side opposite to the nozzle plate.

REFERENCE SIGNS LIST

1 . . . printer, 5 . . . head, 23 . . . passageway member, 33 . . . nozzle plate (plate), 35 . . . metal plate (plate), 37 . . . resin plate (plate), 39 . . . nozzle (passageway), 41 . . . descender (passageway), 43 . . . pressure chamber (passageway), 45 . . . communication passage (passageway), 47 . . . common passageway (passageway), 49 . . . descender-use hole (through hole), 51 . . . pressure chamber-use hole (through hole), 53 . . . communication passage-use hole (through hole), 55 . . . common passage-use hole (through hole), 67 . . . adhesive, and 69 . . . relief groove.

The invention claimed is:

1. An inkjet head comprising:

a resin plate having a first surface and a second surface that is opposite the first surface;

a nozzle plate that includes a nozzle;

a plurality of metal plates that includes:

a first metal plate adhered to the first surface of the resin plate via a first relief groove formed in the first metal plate, and a second metal plate adhered to the second surface of the resin plate via a second relief groove formed in the second metal plate;

a stack of plates formed from the plurality of metal plates, the nozzle plate and the resin plate, wherein the plurality of metal plates and the resin plate that are stacked using an adhesive; and a passageway member formed from the stack of plates that includes a passageway of ink formed by communication of through holes or grooves that are individual provided in the stack of plates wherein the plurality of metal plates further include:

a second part formed from one or more metal second grooved metal plates that are stacked in order on the surface of the resin plate on a nozzle plate side of the stack, wherein each of the one or more second grooved metal plates include a second individual relief groove for the adhesive formed on only a side of the one or more second grooved metal plates facing the resin plate in the stack of plates, a first part formed from one or more first grooved metal plates that are stacked in order on the surface of the second part on the nozzle plate side of the stack, wherein each of the one or more first grooved metal plates include a first individual relief groove for the adhesive on a side of the one or more first grooved metal plates facing the resin plate in the stack and an additional relief groove for adhesive on a side of the one or more first grooved metal plates facing the nozzle plate in the stack of plates, and a third part formed from one or more third grooved metal plates that are stacked on a surface of the first part on the nozzle plate side, wherein each of the third grooved metal plates includes a third individual relief groove for the adhesive on only a side of the one or more third grooved metal plates facing the nozzle plate in the stack of plates, and the nozzle plate is adhered to a surface of the third part on the nozzle plate side in the stack of plates.

2. The inkjet head according to claim 1, wherein the plurality of metal plates further include:

one or more metal first grooved plates that are stacked in order on the first surface of the resin plate, wherein each of the one or more metal first grooved plates includes a first individual relief groove for the adhesive formed on only a side of the one or more first grooved plates facing the resin plate in the stack of plates; and one or more metal second grooved plates that are stacked in order on a second surface of the resin plate, wherein each of the one or more second grooved plates includes a second individual relief groove for the adhesive formed on only a side of the one or more second grooved plates facing the resin plate in the stack of plates.

3. A printer, comprising:

the inkjet head according to claim 2 and a conveyor conveying media with respect to the inkjet head.

4. The inkjet head according to claim 1, wherein the first individual relief groove and the second individual relief groove are not superimposed over each other.

5. A printer, comprising:

the inkjet head according to claim 4 and a conveyor conveying media with respect to the inkjet head.

6. A printer, comprising:

the inkjet head according to claim 1 and a conveyor conveying media with respect to the inkjet head.

7. An inkjet head comprising:

a resin plate having a first surface and a second surface that is opposite the first surface;

a nozzle plate that includes a nozzle, a plurality of metal plates that includes:

a first metal plate adhered to the first surface of the resin plate via a first relief groove formed in the first metal plate, and a second metal plate adhered to the second surface of the resin plate via a second relief groove formed in the second metal plate;

a stack of plates formed from the plurality of metal plates, the nozzle plate, and the resin plate, wherein the plurality of metal plates and the resin plate that are stacked using an adhesive; and a passageway member formed from the stack of plates that includes a passageway of ink formed by communication of through holes or grooves that are individual provided in the stack of plates wherein the plurality of metal plates further include:

a first part formed between the nozzle plate and the resin plate, one or more first grooved metal plates, wherein each of the one or more first grooved metals plates includes a first individual relief groove for the adhesive on a side of the one or more first grooved metal plates facing the resin plate in the stack and an additional relief groove for adhesive on a side of the one or more first grooved metal plates facing the nozzle plate in the stack of plates, a second part formed between the first part and the resin plate, wherein in the second part a second grooved metal plate is not stacked or, if it is stacked, the second grooved metal plate includes a second individual relief groove for the adhesive only on a side of the second grooved metal plate facing the resin plate in the stack of plates, and a third part formed between the first part and the nozzle plate, wherein in the third part a third grooved metal plate is not stacked or, if it is stacked, the third grooved metal plate includes a third individual relief groove for the adhesive only on a side of the third grooved metal plate facing the nozzle plate in the stack of plates; and wherein the nozzle plate does not comprise a relief groove for the adhesive.

8. The inkjet head according to claim 7, wherein, in the first individual relief groove and the additional relief groove are not superimposed over each other.

9. A printer, comprising:

the inkjet head according to claim 7 and a conveyor conveying media with respect to the inkjet head.

10. An inkjet head comprising:

a plurality of plates are stacked using an adhesive, wherein the plurality of plates include:

a resin plate having a first surface and a second surface that is opposite the first surface;

a nozzle plate that includes a nozzle, a first part formed between the nozzle plate and the resin plate that includes one or more first grooved metal plates, wherein each of the one or more first grooved metal plates includes a first individual relief groove for the adhesive on a side of the one or more first grooved metal plates facing the resin plate in the stack and an additional relief groove for adhesive on a side of the one more first grooved metal plates facing the nozzle plate in the plurality of plates, a second part formed between the first part and the resin plate, wherein in the second part, a second grooved metal plate is not stacked or, if it is stacked, the second grooved metal plate includes a second individual relief groove for the adhesive only on a side of the second grooved metal plate facing the resin plate in the plurality of plates, and a third part formed between the first part and the nozzle plate, wherein in the third part, a third grooved metal plate is not stacked or, if it is stacked, the third grooved metal plate includes a third individual relief groove for the adhesive only on a side of the third grooved metal plate facing the nozzle plate in the plurality of plates; and wherein the nozzle plate does not comprise a relief groove for the adhesive.

11. The inkjet head according to claim 10, wherein the first individual relief groove and the additional relief groove are not superimposed over each other.

12. A printer, comprising:

the inkjet head according to claim 10, and a conveyer conveying media with respect to the inkjet head.

* * * * *